United States Patent [19]

Simons

[11] 4,371,015

[45] Feb. 1, 1983

[54] TONER LOADING SYSTEM HAVING CARTRIDGE WITH DISPLACEABLE DIAPHRAGM

[75] Inventor: Peter B. Simons, Los Altos, Calif.

[73] Assignee: TBS, Inc., Mountain View, Calif.

[21] Appl. No.: 219,962

[22] Filed: Dec. 24, 1980

[51] Int. Cl.[3] ..... B65B 1/06; B67B 7/24

[52] U.S. Cl. ..... 141/352; 141/330; 141/363; 222/81; 251/149.1

[58] Field of Search ..... 141/329, 330, 351, 352, 141/360, 363-366; 222/80, 81, 89, 91, 541, DIG. 1; 251/149.1, 149.6, 149.7

[56] References Cited

U.S. PATENT DOCUMENTS

| | | | |
|---|---|---|---|
| 1,092,673 | 4/1914 | Stephens | 251/149.1 |
| 3,670,728 | 6/1972 | Dabney | 222/81 X |
| 3,880,214 | 4/1975 | Slavin | 251/149.6 X |
| 4,060,105 | 11/1977 | Feldeisen | 222/DIG. 1 X |

FOREIGN PATENT DOCUMENTS

| | | |
|---|---|---|
| 250105 | 4/1926 | United Kingdom . |
| 915467 | 1/1963 | United Kingdom . |
| 1505878 | 3/1978 | United Kingdom . |
| 1559252 | 1/1980 | United Kingdom . |

*Primary Examiner*—Frederick R. Schmidt

*Attorney, Agent, or Firm*—Flehr, Hohbach, Test, Albritton & Herbert

[57] ABSTRACT

System for loading toner into a laser copier or other machine. The toner is packaged in a cartridge having a discharge opening closed by a displaceable diaphragm. A filler neck is mounted on the machine in fluid communication with the toner hopper for receiving the cartridge, and a pin within the filler neck engages the diaphragm to dislodge the same from the discharge opening when the cartridge is inserted into the neck.

6 Claims, 2 Drawing Figures

TONER LOADING SYSTEM HAVING CARTRIDGE WITH DISPLACEABLE DIAPHRAGM

This invention pertains generally to laser copy machines and more particularly to a system for loading toner into such machines.

Laser copy machines such as the IBM Model 3800 utilize a carbon type toner similar to that used in xerographic photocopy machines and in computer print-out machines. This toner is in the form of a fine powder which is extremely messy and difficult to clean up when spilled, and it is difficult to load the toner into a machine from conventional containers without some spillage.

With the IBM Model 3800 copier, toner loading is particularly difficult and time consuming. The toner is packaged in a plastic bag, and in order to load the toner into the machine, it is necessary to turn off the machine, lift the splicing table away from its normal operational position, insert the toner, replace the splicing table, and restart the machine. This operation takes about 10–15 minutes.

It is in general an object of the invention to provide a new and improved system for loading toner into a machine.

Another object of the invention is to provide a system of the above character in which the spillage of toner is substantially eliminated.

Another object of the invention is to provide a system of the above character in which the toner is loaded into the machine quickly and easily without shutting down the machine.

These and other objects are achieved in accordance with the invention by providing a toner cartridge having a discharge opening closed by a displaceable diaphragm. A filler neck is mounted on the machine in fluid communication with the toner hopper for receiving the cartridge, and a pin within the filler neck engages the diaphragm to dislodge the same from the discharge opening when the cartridge is inserted into the neck.

Figure 1:
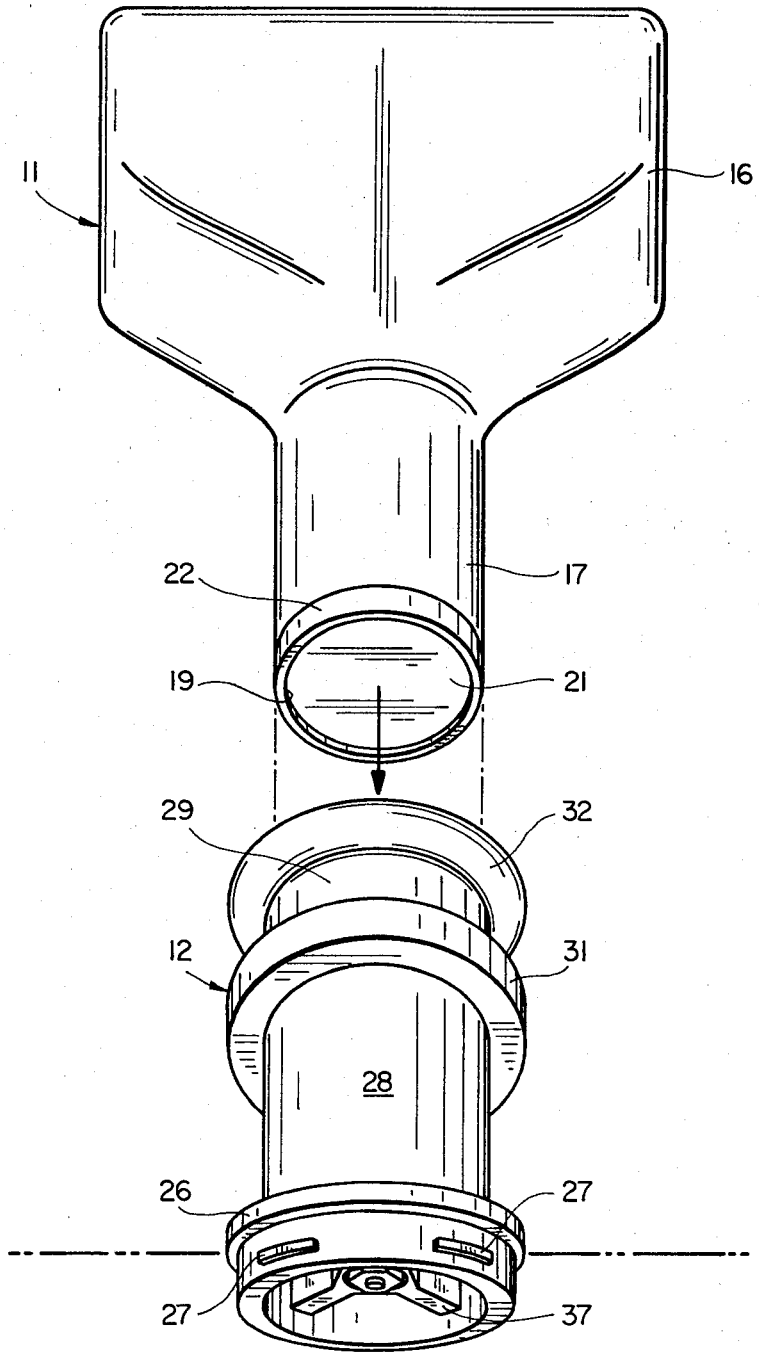
FIG. 1 is an isometric view, partly exploded, of one embodiment of a toner loading system according to the invention.

As illustrated in the drawings, the toner loading system comprises a cartridge 11 in which the toner is packaged, and a filler neck assembly 12 which is mounted on the copy machine to aid in the transfer of toner from the cartridge to the machine.

Figure 2:
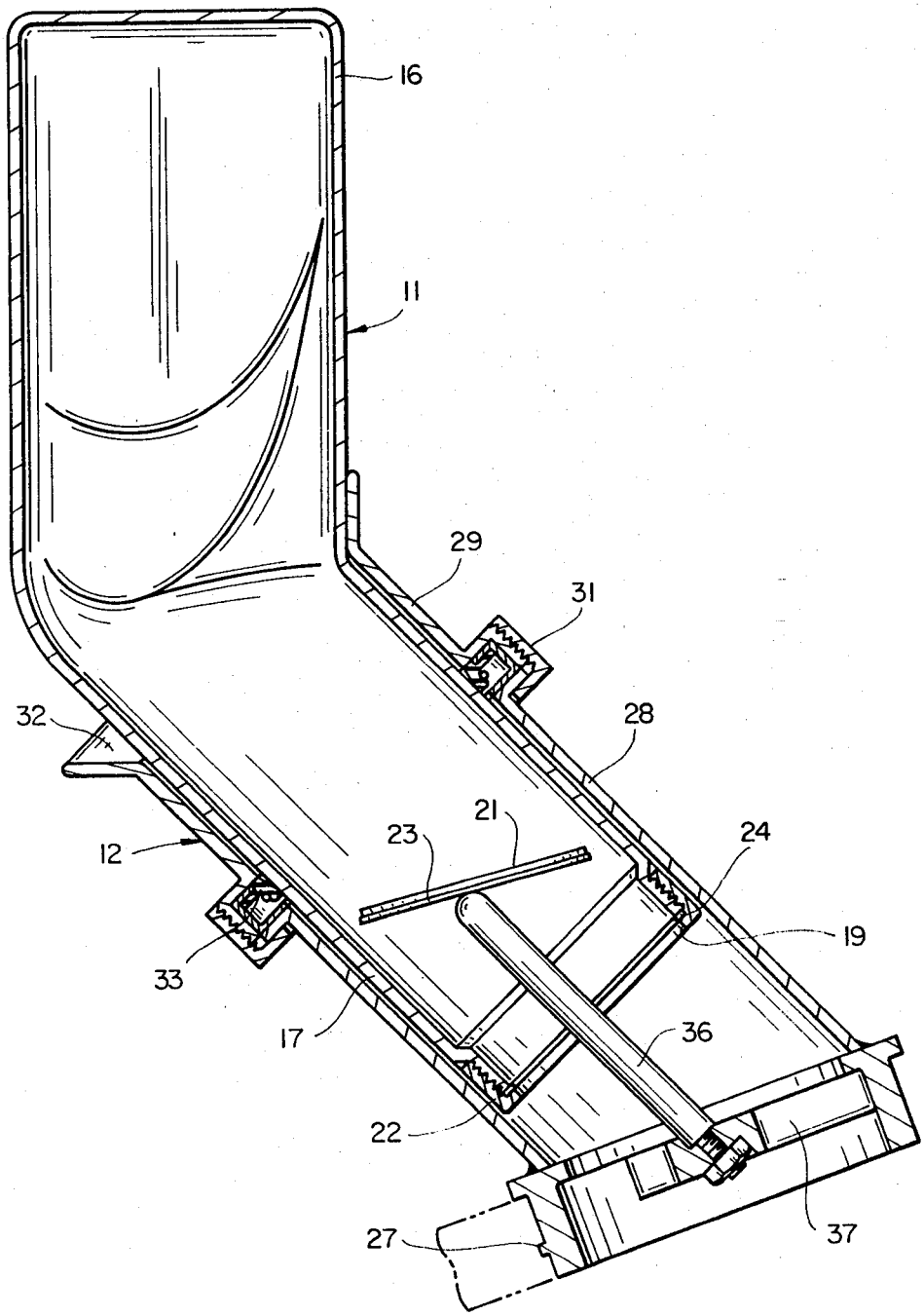
FIG. 2 is an enlarged center line sectional view of the embodiment of FIG. 1 in its operational position on a copy machine.

Cartridge 11 comprises a body portion 16 and a spout portion 17. The spout portion extends outwardly from one side of the body portion, and in the embodiment illustrated, the body portion is generally rectangular and the spout portion is generally cylindrical. The corners of the body portion are, however, rounded and the walls of the body portion adjacent to the spout portion are inclined to provide a smooth transistion between the two portions of the container. As best seen in FIG. 2, the spout portion extends from the body portion at an angle on the order of 135°.

The body portion and the spout portion of the container are formed as a hollow unitary structure of a suitable material such as rigid or semi-rigid plastic, and a quantity of toner material (not shown) is contained within the cartridge.

A discharge opening 19 is formed at the distal end of the spout portion of the cartridge, i.e. the end opposite body portion 16. This opening is closed and sealed by a displaceable diaphragm 21 of non-rupturable material. The diaphragm is yieldably retained in its sealing position by a retainer ring 22 which is threadedly mounted on spout portion 17. In the embodiment illustrated, diaphragm 21 has a peripheral flange 23 which is releasably captured in a groove 24 formed between the axially confronting surfaces of spout portion 17 and retaining 22. The diaphragm is fabricated of a non-rupturable, semirigid plastic material, and it provides a fluid tight seal for the cartridge. As discussed more fully hereinafter, the diaphragm can be dislodged from its sealing position by the application of an inwardly directed force.

Filler neck 12 is mounted on the copy machine in fluid communication with the toner hopper of the machine. At its lower or inner end, the filler neck is provided with a connector 26 having external lugs 27 for engagement with a mating connector on the machine. A lower tube section 28 extends upwardly from connector 26 and is joined to an upper tube section 29 by a retaining ring 31. In the embodiment illustrated, tube sections 28, 29 are generally cylindrical and of slightly larger diameter than spout portion 17 of the toner cartridge, whereby the spout portion of the cartridge can be inserted into the filler neck in telescopic fashion. The outer portion 32 of upper tube section 29 is flared conically to facilitate insertion of the cartridge into the filler neck, and an annular seal 33 engages the outer wall of the spout portion to provide a fluid type seal between the toner cartridge and the filler neck.

In the embodiment illustrated, the filler neck extends upwardly and outwardly from the copy machine at an angle on the order of 45° to the vertical. This inclination is particularly desirable on machines such as the IBM Model 3800 where the inlet to the toner hopper is located beneath the splicer table. When positioned as shown, the filler neck extends out from beneath the splicer table, and the outer end of the filler neck is accessible externally of the copy machine without disturbing the splicer table. The angle of inclination of the filler neck is supplementary to the angle between the body portion and the neck portion of the toner cartridge, with the result that the body portion of the cartridge aligned vertically above the outer end of the filler neck when the cartridge is oriented as illustrated in FIG. 2. In this position, the cartridge will not interfere with the use of the splicer table, or the other functions of the machine.

Means is provided for dislodging diaphragm 21 from the discharge opening of the toner cartridge as the cartridge is inserted into the filler neck. This means includes a pin 36 which is mounted in a stationary position on a spider 37 at the lower end of the filler neck. This pin extends upwardly in an axial direction with in the filler neck and is positioned to apply an inwardly directed force to the diaphragm to dislodge the same from the discharge opening as the spout portion of the cartridge is inserted into the filler neck.

Operation and use of the toner loading system are as follows. The filler neck is mounted on the copy machine and oriented in the manner illustrated in FIG. 2. The sealed toner cartridge is inserted into the filler neck and rotated to the orientation shown, i.e. with the body portion extending in a generally vertical direction. As the spout portion of the cartridge enters the lower section of the filler neck, diaphragm 21 abuts against the upper end of pin 36 and is thereby dislodged from the discharge opening, whereupon the toner flows quickly and freely through the opening from the cartridge to the machine. Being of larger diameter than the discharge opening and being fabricated of non-rupturable material, diaphragm 21 will remain within the cartridge after it is dislodged from the discharge opening, rather than falling into the machine. When the diaphragm is dislodged by pin 36, it is moved away from the discharge opening so that the opening is completely unobstructed and the toner can pour freely through the opening.

The invention has a number of important features and advantages. The toner is packaged in a cartridge which remains sealed until the cartridge is inserted a substantial distance into the filler neck. At that point, the seal is automatically and completely broken, and the toner is free to flow into the machine. Since the filler neck does not interfere with the normal operation of the machine, it can be left in position on the machine, and to add toner it is only necessary to insert a new cartridge into the filler neck. This results in quick, efficient loading of toner, with little or no chance of spillage.

It is apparent from the foregoing that a new and improved toner loading system has been provided. While only one presently preferred embodiment has been described in detail, as will be apparent to those familiar with the art, certain changes and modifications can be made without departing from the scope of the invention as defined by the following claims.

I claim:

1. In a system for loading a fluid toner material into the toner hopper of a machine: a cartridge containing the toner material having a discharge opening sealed by a displaceable diaphragm of non-rupturable material, said diaphragm being larger than the discharge opening and free of attachment to said cartridge but, in a sealing position, extending across and closing said opening and having a peripheral edge portion sealingly but releasably engaging said cartridge inwardly of said discharge opening, a filler neck mounted on the machine in fluid communication with the toner hopper for receiving the toner cartridge, and means entirely within and eccentric to the filler neck for engagement with the diaphragm to dislodge and tilt said diaphragm from its sealing position to open the discharge opening and permit the passage of toner material from the cartridge to the machine when the cartridge is inserted into the filler neck.

2. The system of claim 1 wherein the toner cartridge comprises a body portion and a spout portion extending from the body portion, said discharge opening being located at the distal end of the spout portion.

3. The system of claim 2 wherein the spout portion of the cartridge is inserted into the filler neck, with the body portion positioned above the spout portion whereby the toner material flows in a downward direction from the body portion through the spout portion into the toner hopper.

4. The system of claim 3 wherein the filler neck extends from the machine at a predetermined angle to the vertical, the spout portion extends from the body portion at an angle corresponding to the predetermined angle, and the body portion is aligned vertically above the outer end of the filler neck when the spout portion is inserted into the filler neck.

5. The system of claim 1 wherein the means for dislodging the diaphragm from the opening of the cartridge comprises a pin affixed at one end to the filler neck and extending outwardly from said end in an axial direction within the filler neck.

6. In a system for loading a fluid toner material into a machine: a toner cartridge having a body portion, a spout portion extending from the body portion, a discharge opening at the end of the spout portion, and a displaceable diaphragm of non-rupturable material extending across and closing the discharge opening; a filler neck mounted on the machine for receiving the spout portion of the cartridge in mating relationship; and a pin mounted in a stationary position within and eccentric to the filler neck for engagement with the diaphragm to dislodge and tilt the same from the discharge opening to permit the flow of toner material through said opening into the machine when the spout portion is inserted into the filler neck.

* * * * *